United States Patent [19]

Seron

[11] 4,359,961

[45] Nov. 23, 1982

[54] PLASTIC WHISTLE

[75] Inventor: Suren V. Seron, Joliet, Ill.

[73] Assignee: Seron Manufacturing Company, Joliet, Ill.

[21] Appl. No.: 223,100

[22] Filed: Jan. 7, 1981

Related U.S. Application Data

[63] Continuation-in-part of Ser. No. 86,704, Oct. 22, 1979, abandoned.

[51] Int. Cl.[3] ..... B06B 3/00

[52] U.S. Cl. ..... 116/137 R; 46/179

[58] Field of Search ..... 116/137 R, 138, 139, 116/142 R, 142 FP, 147, DIG. 44; 63/15.5, 15.45, 15.65, 15.6, 15.2, 15.4, 15.7; 46/179

[56] References Cited

U.S. PATENT DOCUMENTS

| | | | |
|---|---|---|---|
| 2,113,396 | 4/1938 | Butterfield | 116/137 R |
| 2,958,307 | 11/1960 | Best | 116/137 R |
| 4,171,677 | 10/1979 | Hibell | 116/137 R |

FOREIGN PATENT DOCUMENTS

| | | | |
|---|---|---|---|
| 116329 | 1/1943 | Australia | 46/179 |
| 447673 | 5/1936 | United Kingdom | 46/179 |
| 620720 | 3/1949 | United Kingdom | 46/179 |
| 1432363 | 4/1976 | United Kingdom | 340/404 |

*Primary Examiner*—Edward R. Kazenske
*Assistant Examiner*—Denis E. Corr
*Attorney, Agent, or Firm*—Wegner, McCord, Wood & Dalton

[57] ABSTRACT

A plastic whistle including a main whistle body provided with a relatively narrow, elongated throat terminating at one end in a mouthpiece opening and at its other end, in an enlarged sound chamber. The throat and the chamber are open along a common side of the body. An orifice is located in the body and opens to the chamber and is disposed in the side of the body adjacent the common side mentioned above. A closure is provided for the common side and has a peripheral size and shape substantially the same as the periphery of the common side and mounts a tab extending partially into the throat so as to have opposite sides of the tab in abutment with opposed parts of the body at the mouthpiece opening to thereby support the body against an external clamping force applied by the teeth of a user of the whistle to prevent fracture of the throat.

9 Claims, 10 Drawing Figures

Fig. 1
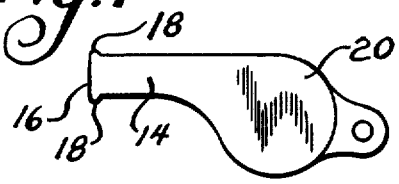
Fig. 2
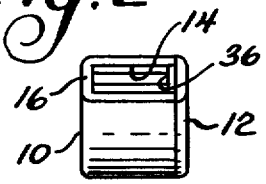
Fig. 3
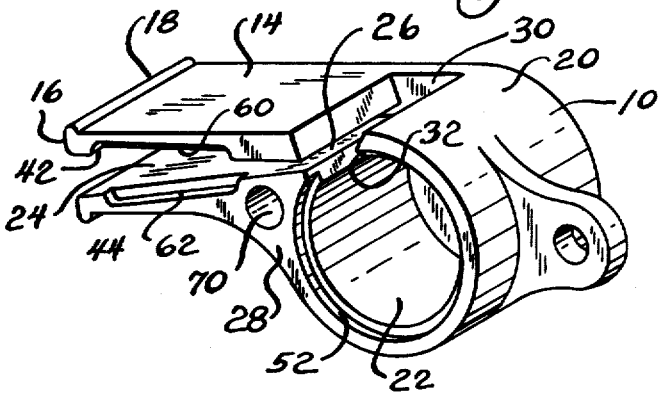
Fig. 4
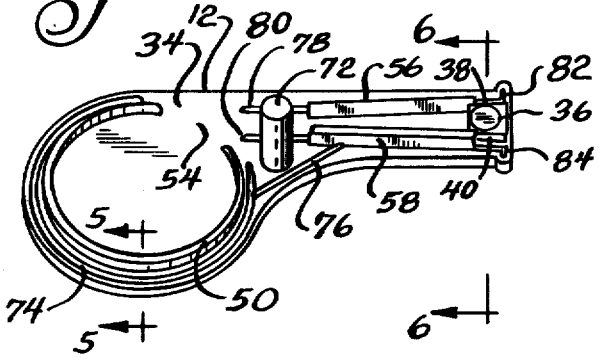
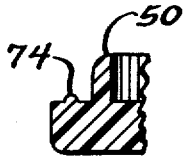
Fig. 5
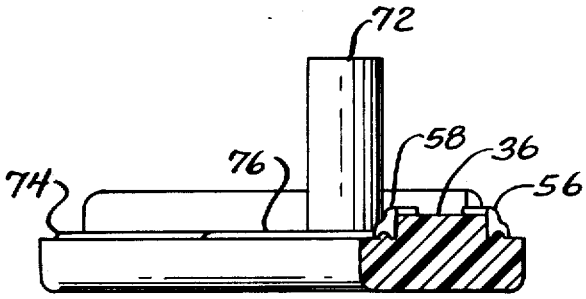
Fig. 6

PLASTIC WHISTLE

DESCRIPTION

CROSS-REFERENCE

This application is a continuation-in-part of my copending application Ser. No. 86,704, filed Oct. 22, 1979 and entitled "Plastic Whistle" now abandoned.

TECHNICAL FIELD

This invention relates generally to whistles, and more particularly, to plastic whistles.

BACKGROUND ART

In United Kingdom patent specification No. 620,720, accepted Mar. 29, 1949, to Hudson, there is described a plastic whistle formed of two basic parts. The first part includes a main body which includes a channeled throat merging into an internal cavity and both opening to one side of the body. The opening is closed by a closure or cover part which is adhered to the body by means of adhesive or the like to close the open side of the body and captivate a ball or the like within the cavity. While the structure performs relatively well as a whistle, it is subject to a number of substantial defects. Over a period of time, the adhesive may age and weaken to the point where the cover may disassociate from the body, thereby rendering the whistle useless.

Additionally, if care is not taken to insure that adhesive is present along the entire interface of the cover and body, leakage paths for air channeled into the whistle through the throat exist and air leaving the whistle via such leakage paths is not effective in producing the desired sound. Consequently, the efficiency of the whistle in converting a stream of air under pressure into sound is lessened.

Finally, since the air inlet opening in the throat of the body is not particularly strong in the area adjacent to the cover, a clamping force on the mouthpiece of the whistle exerted thereon by the teeth of the user will tend to cause the mouthpiece to collapse and if the adhesive fractures, collapse will in fact occur. Thus, the whistle can be rendered useless.

In U.S. Pat. No. 2,113,396, issued on Apr. 5, 1938, to Butterfield, there is also described a plastic whistle made in two parts. In one embodiment thereof, the whistle is made with a major body and a lesser cover in a fashion somewhat similar to that disclosed in the Hudson British patent specification identified above. In this embodiment, the two parts are held together by a rivet or the like with the cover being received in a recess provided with a shoulder in the main body.

Because the cover is received in a recess in the main body, it provides support for the throat adjacent the mouthpiece against collapse due to tooth pressure. And the use of a rivet for securing the parts together does eliminate the problem of aging adhesive. However, the entire interface of the cover and the body is not sealed completely effectively with the consequence that leakage around the entire interface of the body and the cover can occur, again, lowering the efficiency of the process of converting a moving air stream to sound provided by the whistle. Moreover, because the cover must be inserted in a recess, assembly is made more difficult. The appearance of the exterior of the whistle may be adversely affected to the extent that the thickness of the cover deviates from the depth of the recess in which it is received.

DISCLOSURE OF THE INVENTION

The present invention is directed to overcoming one or more of the above problems.

According to the present invention there is provided a plastic whistle including a main whistle body having a relatively narrow, elongated throat terminating at one end in a mouthpiece opening and its other end in an enlarged sound chamber. The throat and the chamber open along a common side of the body. An orifice is disposed in the body and opens to the chamber with the orifice being on a side of the body adjacent the common side and extending therethrough. A closure is provided for the common side and has a peripheral size and shape substantially the same as the periphery of the common side. The closure has a side in abutment with the body and, at the part thereof abutting the throat mouthpiece end, includes a tab extending from the side partially into the throat. The tab has opposite sides in abutment with opposed parts of the body defining the mouthpiece opening to thereby support the parts against an external clamping force supplied by the teeth of a user of the whistle to prevent fracture of the throat. Means are provided for securing the closure to the body.

In a highly preferred embodiment, the closure side further includes a first relatively large ridge extending therefrom which is shaped and sized to enter the chamber and abut a wall thereof without closing the orifice. Second and third generally parallel, relatively large ridges are shaped and sized to enter the throat and abut the opposed parts thereof without closing the throat. There is also provided on one or the other or both parts relatively small ridge means located to abut the other part at least at locations not abutted by the relatively large ridges. The plastic of which the whistle is formed is a thermoplastic and the securing means comprise ultrasonic welds between the body and the relatively large ridges to secure the two together. Additional ultrasonic welds extend between the relatively small ridge means and the abutting part and together with the ultrasonic weld defining the securing means serve to establish a seal between the body and the closure at the interface thereof to prevent the exit of air from the throat and the chamber except through the orifice. Consequently, leakage paths at the interface between the closure and the body are avoided to thereby maximize the efficiency of the process of converting and moving air stream to sound.

Other objects and advantages will become apparent from the following specification taken in connection with the accompanying drawings.

DESCRIPTION OF THE DRAWINGS

FIG. 1 is a side elevation of a whistle made according to the invention;

FIG. 2 is an elevation of the whistle taken from the throat end thereof;

FIG. 3 is a perspective view of the main body of a whistle made according to the invention;

FIG. 4 is a perspective view of the closure of the whistle;

FIG. 5 is an enlarged, fragmentary sectional view taken approximately along the line 5—5 in FIG. 4;

FIG. 6 is an enlarged, sectional view taken approximately along line 6—6 in FIG. 4;

BEST MODE FOR CARRYING OUT THE INVENTION

Figure 7:
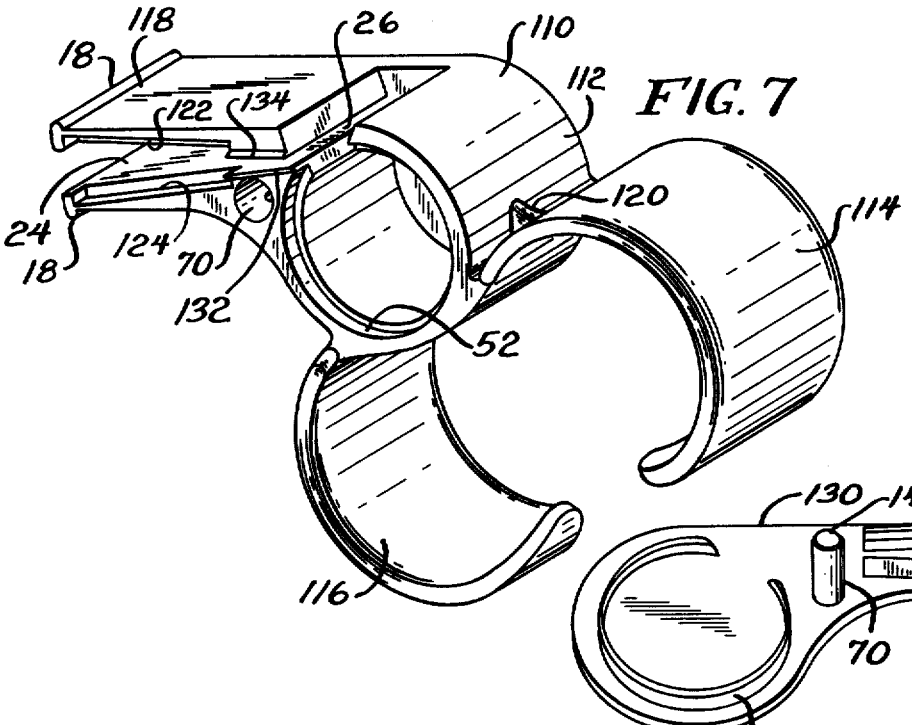
FIG. 7 is a view similar to FIG. 3 but of a modified embodiment of the invention.

An exemplary embodiment of a plastic whistle made according to the invention is illustrated in the drawings and with reference to FIGS. 1 and 2 is seen to include a main body 10 and a cover or closure 12. The whistle includes a throat 14 terminating at an end 16 defining a mouthpiece and which is provided with oppositely erected retention flanges 18 which serve to prevent the whistle throat 14 from sliding easily past the lips of a user thereof.

The end of the throat 14 opposite the end 16 merges with a bulbous chamber portion 20. As seen in FIG. 3, the main body 10 in the chamber area 20 includes a generally cylindrical cavity 22. The throat 14 contains a channel 24 which is relatively narrow from top to bottom as viewed in FIG. 3 and relatively wide side to side as viewed in FIG. 3 and which opens into the cavity 22 as at 26.

Both the throat channel 24 and the chamber or cavity 22 open to a common side 28 of the main body 10. The main body 10 includes an additional opening or orifice 30 provided with a sharp edge 32 in alignment with the throat opening 26 and at which sound is generated in a conventional fashion by a stream of air entering the cavity 22 via the throat channel 24. As is well known, typically a ball or the like (not shown) will be disposed in the cavity 22.

The opening in the common side 28 of the main body is closed by the closure 12. As can be seen from FIGS. 1-4, inclusive, the closure 12 has a shape and size substantially identical to that of the periphery of the common side 28 of the body 10. One side 34 of the closure 14 is adapted to abut the common side 28 of the body 10. At the mouthpiece end of the closure 14, the closure side 34 carries an inwardly directed tab 36 (FIGS. 2 and 4) having opposed sides 38 and 40. When the closure 14 is assembled to the body 10, the side 38 of the tab 36 extends partially into the throat channel 24 so as to abut the upper wall 42 thereof. The lower side 40 of the tab 36 will be in abutment with the lower wall 44 of the throat 14.

As can be seen in FIG. 2, the tab 36 thus supports opposed parts of the throat 14 adjacent the common side 28 against collapse in response to clamping pressure applied to the throat 14 by the teeth of the user of the whistle.

The closure side 34 includes an inwardly directed, relatively large ridge 50 which is sized to be received within the cavity 22 of the body 10 in abutment with the sides of the same. In a preferred embodiment, the ridge 50 is received in a small recess 52 surrounding the cavity 22 at its point of opening to the side 28. It will be noted that the inward extension of the ridge 50 includes a relieved area 54 which would align with the orifice 30 so as to not close the same.

The closure side 34 also includes second and third relatively large ridges 56 and 58 which are generally parallel and located so as to abut opposite sides of the throat 14 defining the throat channel 24. In a preferred embodiment, the throat channel 24 is provided with small recesses 60 and 62 adjacent the common side 28 for receipt of the ridges 56 and 58, respectively.

In a preferred embodiment of the invention, both body 10 and the closure 12 are formed of a thermoplastic material so that when assembled together with the ridges 50, 56 and 58 within the recesses 52, 60 and 62, respectively, they may be secured together by conventional ultrasonic welding techniques. As is well known, the application of ultrasonic energy to the components when assembled together will, in less than a second, generate a weld between the two by reason of relative movement between the two generating sufficient friction as to elevate the plastic above its flow temperature.

While the use of the recesses 52, 60 and 62 as points of receipt of the ridges 50, 56 and 58, respectively, serves as an assembly aid, it is preferred that the body 10 be provided with a pilot hole 70 which opens perpendicularly to the common side 28. The closure side 34 is provided with an elongated pilot post 72 extending perpendicularly from the side 34 and sized to be received in the hole 70. Thus, disposition of the post 72 in the hole 70 pilots the closure 12 onto the body 10 with final alignment being provided by the entry of the ridges 50, 56 and 58 into their respective recesses. The components are then ultrasonically welded together as mentioned above, the ultrasonic weld securing means providing a positive means of securement without concern for aging of adhesive.

The whistle structure is completed by the presence of relatively small ridge means on the closure side 34 for abutment with the body 10. The ridge means are located on the closure side 34 so as to be in abutment with the body common side 28 at locations whereat the ridges 50, 56 and 58 are not disposed. Consequently, when the whistle is assembled and ultrasonic welding is applied, further ultrasonic welds between the body 10 and the closure 12 will occur at the ridge means to provide a positive seal and eliminate all leakage paths at the interface of the closure 12 and the body 10 to maximize sound generation.

As seen in FIG. 4, the ridge 50 is surrounded by a relatively small ridge 74. As seen in FIG. 5, the ridge 74 has a height considerably less than half that of the ridge 50.

A further, relatively small ridge 76 interconnects the ridge 74 and the ridge 58 in the area whereat the throat 14 merges with the chamber 20. Additional relatively small ridges 78 and 80 extend from the ridges 56 and 58 in a generally parallel fashion toward the orifice 30 to a point whereat they would terminate at the throat opening 26.

L-shaped, relatively small ridges 82 and 84 extend forwardly from the ridges 56 and 58 to the mouthpiece end 16. All of the relatively small ridges 76, 78, 80, 82 and 84 are proportioned in height to the respective ridges 50, 56 and 58 in the same proportion as the ridge 74.

As a consequence of this construction, it will be appreciated that, except for the mouthpiece opening and the sound producing orifice 30, the entire interface of the closure 12 and the body 10 is sealed by ultrasonic welding between the ridges 74, 76, 78, 80, 82 and 84 and the common side 28 of the body 10. Thus, there are no leakage paths and all air directed to the cavity 22 via the mouthpiece can exit only through the orifice 30. Thus, maximum sound conversion efficiency is obtained.

A modified embodiment of a plastic whistle made according to the invention is illustrated in FIGS. 7-10 inclusive. In the interest of brevity, those parts of the embodiment shown in FIGS. 7–10 which are identical to corresponding parts in the embodiment of FIGS. 1–6 will be given like reference numbers and will not be further described except to the extent necessary to obtain an understanding of the embodiment of FIGS. 7–10.

Referring to FIG. 7, there is provided a whistle body 110 generally similar to the whistle body 10 previously described. However, near the lower end of the chamber portion 112 of the body 110, there are integrally formed on the body 110 arcuate tongues 114 and 116. The tongue 114 is concave towards the mouthpiece 118 of the whistle while the tongue 116 is concave towards the tongue 14. The curvatures and spacing selected are such that the user of the whistle may slip two or three fingers into the area between the tongues 114 and 116 to provide a so-called fingergrip whistle.

As mentioned earlier, the whistle is formed of thermoplastic and in the case of the embodiment illustrated in FIG. 7, it is preferred that the plastic be selected such that it will soften when immersed in boiling water. Thus, the user of the whistle may immerse the tongues 114 and 116 into boiling water until the plastic softens, remove the tongues 114 and 116 from the boiling water and place them about his fingers. While the plastic is still pliable, the user may then increase or decrease the spacing between the tongues 114 and 116 to fit the whistle for his particular hand.

Preferably, a strengthening rib 120 is located between each of the tongues 114 and 116 and the chamber portion 112 of the whistle where the tongues join the same. This insures that during the foregoing adjustment process, should the plastic not be sufficiently softened when the adjustment is to be made, the tongues 114 and 116 will not separate from the body 110 at their juncture therewith.

Figure 8:
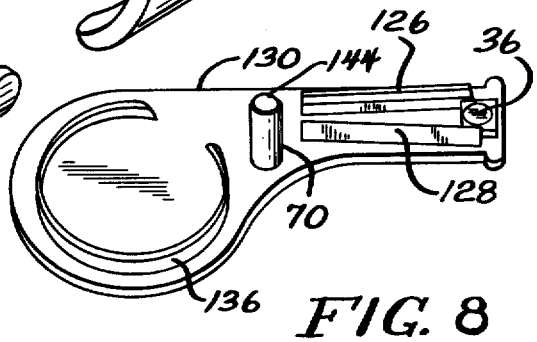
FIGS. 8 and 9 are views of the closure of the modified embodiment.

As can be seen from a comparison of FIG. 7 with FIG. 3, recesses 122 and 124 in the throat 24 of the body 110, which correspond approximately to the recesses 60 and 62 shown in FIG. 3, have been lengthened somewhat in the direction of the retention flanges 18 as compared to the recesses 60 and 62. With reference to FIGS. 4 and 8, it can be likewise seen that large ridges 126 and 128 on the whistle cover 130, and which correspond approximately to the ridges 56 and 58 in FIG. 4 have likewise been lengthened in the same direction and the small ridges 82 and 84 omitted. Because of the extension of the recesses 122 and 124 as well as the ridges 126 and 128 which are received therein in the foregoing fashion, it is not necessary to provide the small ridges 82 and 84 to achieve a seal. The ridges 126 and 128 extend sufficiently toward the retention flanges 18 as to provide a sufficient seal virtually up to the end of the mouthpiece 118 of the whistle. And since the mouthpiece of the whistle, when in use, is within the mouth of the user, there is no concern for a leakage path in this area. Thus, this configuration provides a simplification over that required in the embodiment of FIGS. 1–6.

Again comparing FIGS. 3 and 7 and FIGS. 4 and 8, it will be seen that the small ridges 78 and 80 (FIG. 4) have been omitted from the cover 130 as shown in FIG. 8. Here, however, there is concern for the existence of a leakage path and according to the embodiment of FIGS. 7–10, similar small ridges 132 and 134 are located on the body 110 about the throat 24 and extend from the recesses 122 and 124 to the throat opening 26.

Figure 9:
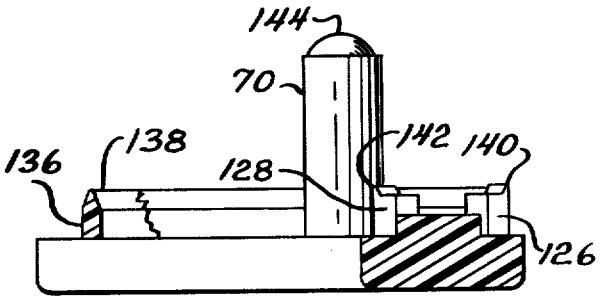

As can be seen from a comparison of FIGS. 8 and 9 with FIGS. 4 and 6 respectively, small ridges 76 and 74 have been omitted entirely from the closure 130. The embodiment of FIGS. 7–10 has no counterparts of such small ridges. Rather, as best seen in FIG. 9, a large ridge 136 corresponding to the large ridge 50 as seen in FIG. 4 is provided with a rather sharply pointed apex 138 as contrasted to the curved apex of the ridge 50 as seen in FIG. 5. This configuration insures complete sealing upon ultrasonic welding of the closure 130 to the body 110 to the point that the small ridges 74 and 76 can be avoided.

In FIG. 9, it will also be observed that the ridges 126 and 128 have, on their tops, small ridges 140 and 142 respectively. The ridges 140 and 142 enhance the seal obtained between the ridges 126 and 128 and the grooves 122 and 124 in the body 110. Additionally, the post 70 is provided with a partial spherical projection 144 at its top. This projection 144 will ultrasonically weld to the bottom of the hole 70 in the body 110.

Figure 10:
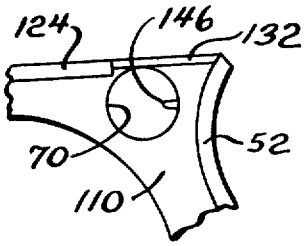
FIG. 10 is an enlarged fragmentary view of the main body of the modified embodiment.

Referring now to FIG. 10, within the hole 70, there extends, lengthwise, a small rib 146. The rib 146 is such that that the post 72 may enter the hole 70 but will be in abutment with the end of the rib 46. Consequently, upon ultrasonic welding, the post 72 will weld to the rib 146.

Finally, as can be plainly seen in FIG. 8, the tab 36, which it will be recalled, prevents collapse of the mouthpiece end 118, is retained.

From the foregoing, it will be appreciated that a whistle made according to the invention eliminates the prior art difficulties of aging adhesive or the failure to place adhesive around the entire interface of the components of a two-part whistle resulting in a leakage path that may reduce efficiency. At the same time, loss of efficiency due to leakage associated with riveted construction is avoided.

In a like vein, support for the mouthpiece end 16 or 118 of the body 10 or 110 respectively is provided through the unique use of the tab 36. In the case of the embodiment shown in FIGS. 7–10, the use of thermoplastic material that will soften in boiling water provides a ready means to facilitate adjustment of the fingergrip tongues 114 and 116 to accommodate a variety of users. Further, the configuration of other components of the whistle illustrated in FIGS. 7–10 and the molding techniques required in forming the body 110 and the closure 130 without sacrificing efficiency and may be employed whether or not the tongues 114 and 116 are utilized.

I claim:

1. A plastic whistle comprising a main whistle body including a relatively narrow, elongated throat with opposed parts and terminating at one end in a mouthpiece opening and at its other end in an enlarged sound chamber, said throat and said chamber being open along a common side of said body;

an orifice in said body opening to said chamber, said orifice being in a side of said body adjacent said common side and extending thereto;

a closure for said common side having a peripheral size and shape substantially the same as the periphery of said common side, said closure having a side in abutment with said body; said closure side, at the part thereof abutting said one end of said throat, including a tab extending from said side partially into said throat and having opposite sides in abutment with said opposed parts of said body defining said mouthpiece opening to thereby support said opposed parts against an external clamping force applied by the teeth of a user of the whistle to prevent fracture of said throat; and means securing said closure of said body.

2. The whistle of claim 1 wherein said closure side further includes ridges in abutment with said body and wherein said plastic is a thermoplastic, said securing means comprising an ultrasonic weld between said ridges and said body.

3. The whistle of claim 1 wherein said closure side further includes a first, relatively large ridge extending therefrom and shaped and sized to enter said chamber and abut a wall thereof without closing said orifice, second and third generally parallel, relatively large ridges shaped and sized to enter said throat and abut said opposed parts thereof without closing said throat, and relatively small ridge means located to abut said body at least at locations not abutted by said relatively large ridges, said plastic being a thermoplastic and said securing means comprising ultrasonic welds between said body and said relatively large ridges, and further ultrasonic welds between said body and said relatively small ridge means, said ultrasonic welds and said further ultrasonic welds serving to establish a seal between said body and said closure at the interface thereof to prevent the exit of air from said throat and said chamber except through said orifice.

4. The whistle of claim 3 wherein said relatively small ridge means extends peripherally about said first ridge.

5. The whistle of claim 3 wherein said body further includes a pilot hole opening on said common side perpendicular thereto, and said closure side includes an elongated, integral pilot post extending perpendicular therefrom and sized to enter said hole to guide said closure into abutment with said body during assembly of said whistle.

6. The whistle of claim 1 wherein said closure side further includes a first, relatively large ridge extending therefrom and shaped and sized to enter said chamber and abut a wall thereof without closing said orifice, second and third, generally parallel, relatively large ridges shaped and sized to enter said throat and abut said opposed parts thereof without closing said throat, and further including relatively small ridge means on one of said closure side and said body and located to abut the other of said closure side and said body at least at locations not abutted by said relatively large ridges, said plastic being a thermoplastic, and said securing means comprising ultrasonic welds between said body and said relatively large ridges, and further ultrasonic welds between said relatively small ridge means and the other of said closure side and said body, said ultrasonic welds and said further ultrasonic welds serving to establish a seal between said body and said closure at the interface thereof to prevent the exit of air from said throat and said chamber except through said orifice.

7. The whistle of claim 6 wherein said relatively small ridge means are located on said body.

8. A plastic whistle comprising a main whistle body including a relatively narrow, elongated throat with opposed parts and terminating at one end in a mouthpiece opening and at its other end in an enlarged sound chamber, said throat and said chamber being open along a common side of said body; an orifice in said body opening to said chamber, said orifice being in a side of said body adjacent said common side and extending thereto; a closure for said common side having a peripheral size and shape substantially the same as the periphery of said common side, said closure having a side in abutment with said body; means interposed between said body and said closure side for securing said closure to said body; and a pair of opposed, finger receiving tongues integrally formed on said body and extending therefrom to define a finger receiving space, said plastic being a thermoplastic that will soften when immersed in a hot liquid so that, by immersion of said tongues in a hot liquid, the same may be softened and thereafter be formed to a configuration suitable for the users fingers.

9. A plastic whistle comprising a main whistle body and including a relatively narrow, elongated throat with opposed parts and terminating at one end in a mouthpiece opening and at its other end in an enlarged sound chamber, said throat and said chamber being open along a common side of said body;

an orifice in said body opening to said chamber, said orifice being in a side of said body adjacent said common side and extending thereto;

a closure for said common side having a peripheral size and shape substantially the same as the periphery of said common side, said closure having a side in abutment with said body;

and ridge means located on at least one of said closure and said body and engaging the other of said closure and body, said ridge means being ultrasonically welded to the other of said closure and said body to secure said closure to said body and substantially seal the interface between the two;

said whistle further including a pair of fingergrip tongues integrally formed with said body and extending therefrom to define a space for the receipt of the fingers of the user of the whistle, said plastic being a thermoplastic that will soften in boiling water so as to allow said tongue, when softened, to be conformed to the users fingers.

* * * * *